US007438076B2

(12) United States Patent
Cerruti et al.

(10) Patent No.: US 7,438,076 B2
(45) Date of Patent: Oct. 21, 2008

(54) DISPENSER DEVICE PARTICULARLY FOR DISHWASHING MACHINES

(75) Inventors: Daniele Cerruti, Fontanetto Po (IT); Fabio Nebbia, Giarole (IL); Franco Musso, Casale Monferatto (IT); Corrado Gambino, Casale Monferatto (IT)

(73) Assignee: Eltek S.p.A., Casale Monferrato (AL) (IT)

( * ) Notice: Subject to any disclaimer, the term of this patent is extended or adjusted under 35 U.S.C. 154(b) by 562 days.

(21) Appl. No.: 10/496,412

(22) PCT Filed: Nov. 25, 2002 (Under 37 CFR 1.47)

(86) PCT No.: PCT/IB02/04916

§ 371 (c)(1), (2), (4) Date: Dec. 13, 2004

(87) PCT Pub. No.: WO03/045214

PCT Pub. Date: Jun. 5, 2003

(65) Prior Publication Data

US 2005/0115595 A1 Jun. 2, 2005

(30) Foreign Application Priority Data

Nov. 26, 2001 (IT) ..... TO2001A1103

(51) Int. Cl.
*B08B 3/08* (2006.01)

(52) U.S. Cl. ..... 134/93

(58) Field of Classification Search ..... 134/93
See application file for complete search history.

(56) References Cited

U.S. PATENT DOCUMENTS 5,031,649 A * 7/1991 Marks et al. ..... 134/57 D
5,261,432 A * 11/1993 Sandrin ..... 134/93
5,884,821 A * 3/1999 Wilhelmstaetter et al. ... 222/511

FOREIGN PATENT DOCUMENTS

JP 53-101862 * 9/1978

* cited by examiner

*Primary Examiner*—Frankie L Stinson
*Assistant Examiner*—Samuel A Waldbaum
(74) *Attorney, Agent, or Firm*—Levine & Mandelbaum

(57) ABSTRACT

A washing agents dispenser for dishwashing machines has a body with a compartment for containing a washing agent, a compartment cover which can be opened and closed in a planar motion, a locking/release system for the cover, and a seal, for the cover, having a surface which is partially inclined with respect to the plane of motion of the cover for facilitating closing of the cover.

31 Claims, 11 Drawing Sheets

Fig. 3 PRIOR ART
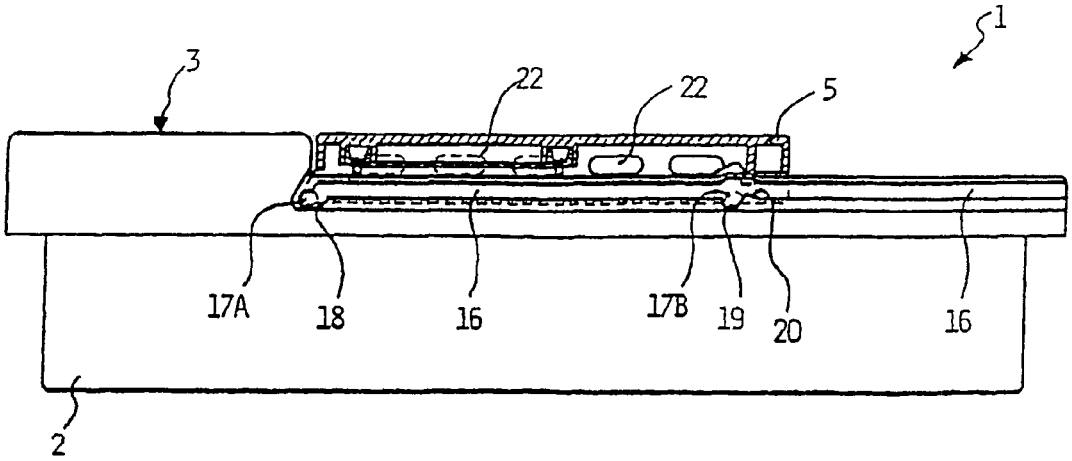
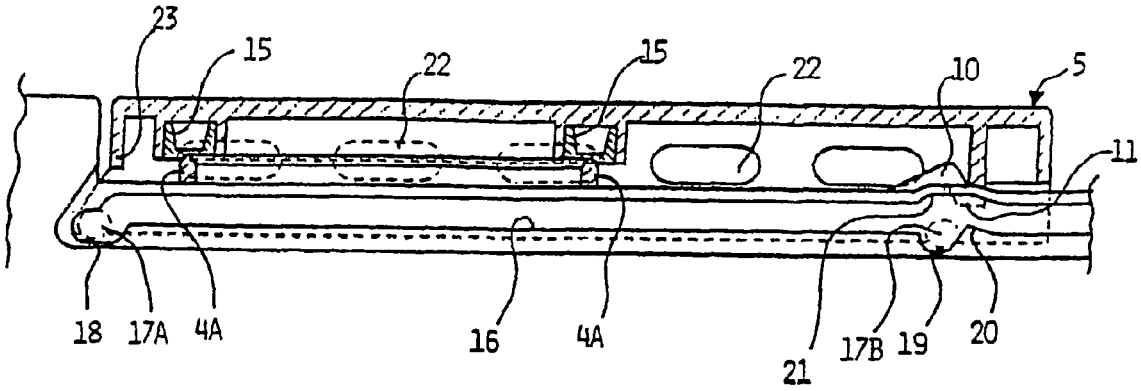
PRIOR ART
Fig. 4

DISPENSER DEVICE PARTICULARLY FOR DISHWASHING MACHINES

BACKGROUND OF THE INVENTION

The present invention relates to a washing agents dispenser device, particularly developed for dishwashing machines, as described in the preamble of the claim 1, and actuation method thereof.

Dishwashing machines, in particular household dishwashers, usually employ dispenser devices for dispensing washing agents, which are normally housed in the dishwasher inner door.

Devices capable of dispensing different types of washing agents, such as detergent and rinse aids, are widely spread. These devices are provided for dispensing the detergent and rinse aids at different pre-set times, being their operation controlled by an appropriate programmer or timer of the dishwashing machine.

The use of a well defined type of dispenser devices as illustrated, described and taught in the U.S. Pat. No. 5,884,821 or European Patent No. EP 0780087 B1 is already known. These documents disclose a dispenser device as shown in the annexed FIGS. 1-4, globally indicated with reference number 1, which consists of a body 2 comprising and/or incorporating the following parts:

- a compartment 4 for containing a washing agent;
- a sliding cover 5 from a closed position to an open position of the above compartment 4;
- locking/release means 8, 10, 11, 12, 13, 14 related to the sliding cover 5, which are associated to an appropriate actuator for releasing the cover 5, said elements being only partially apparent in the above figures;
- a rinse-aid or liquid washing agent dispenser 3.

In particular, the opening of the sliding cover 5 is controlled by common elastic or thrusting means 14, such as an appropriately constrained cylindrical helical spring; the sliding cover 5 has extensions 17A and 17B restraining it to matching sliding guides 16, 18, 19, 20, 21 provided in the body 2, which are configurated for guiding it along translations that follow a mainly straight path.

Reference is made to the above documents for further specifications of such a device known to the technical state of art, such as a complete set of figures rather than a detailed description or its operation.

Special attention is paid to the operation of the dispenser device 1 for closing the compartment 4, which is performed manually by the user of the dishwashing machine. Actually, in order to start a wash cycle, at the beginning of each wash cycle the user has to return the sliding cover 4 to its closed position after loading the washing agent in the compartment 4.

Performance of this operation is not quite simple and immediate, since when the operator slides the sliding cover 5 to its closed direction, the latter will be engaged at translation end, i.e. with the front relief 17A reaching the lead-in location of the step guide 18, with its rear relief 17B in line with the rise of the inclined plane 20 related to the lead-in guide 19. Further in its guided movement, the rear relief 17B will rise on the inclined plane 20 and the sliding cover 5 take a slightly inclined position. Then the front relief 17A slides on the joining inclined plane of the step guide 18 downwards, i.e. putting the front side of the gasket 15 in contact with the first sealing edge 4A', i.e. the one facing the dispenser 3, whereas the rear side lifts up. When the relief 17B exceeds the inclined plane 20 entering the depression of the lead-in guide 19, also the rear side of the sliding cover 5 goes downwards, bringing the lower side of the gasket 15 in contact with the second sealing edge 4A". The above details are clearly illustrated in the FIGS. 3 and 4, where the sliding cover 5 is shown in its closed position.

Once the inclined plane 20 has been exceeded, a mutual coupling between the tooth 10 of the hooking element 8 and tooth 11 of the cover 5 occurs as described hereafter, so the cover will be hooked in its closed position.

The sliding cover 5 moves for a length according to a substantially plane motion, over a substantially straight path. When the rear relief 17B is in line with the rise of the inclined plane 20, the sliding cover 5 moves on inclined planes with respect to the motion plane identified by the substantially plane motion. At the end of the above movement, the sliding cover 5 practically requires a slight pressure in orthogonal way to the motion plane, favouring the engagement between the gasket 15 and sealing edges 4A and 4B, i.e. the closure of the compartment 4 by interposition of an elastic seal. Finally, in order to ensure a final locking or hooking in the closed position, the user should further pull the sliding cover 5 to for another very short length along the substantially straight path, minding to keep it pressed towards the dispenser, i.e. keeping the gasket 15 pressed over the edges 4A and 4B for facilitating a housing of the front relief 17A in the horizontal development of the step guide 18, as highlighted in FIG. 4.

According to experience, a closure of the sliding cover 5 according to the above procedure is not immediately guessed by the users of dishwashing machines, who generally perform more than one operation in the attempt of hooking the cover in its closed position. When closing the cover 5, these users do not pull the cover 5 to up to its complete engagement between the teeth 10 and 11, forgetting to press the cover 5 towards the compartment 4 and further pull it straight to for its short final length before hooking.

Performing just an intuitive translation movement, i.e. pulling to according to the straight closure path, without appropriately guiding or directing the cover as described above, difficulties may arise in closing and/or hooking the cover correctly.

If the cover does not close, it is obviously impossible to use the household appliance correctly; the same applies in the verifiable instance of a faulty hooking of the cover 5, which may open before the time set by the timer of the dishwashing machine and cancel the washing efficiency of the subsequent wash cycle, which will be performed without detergent.

A further drawback due to the above difficulty of hooking the cover for its closure may be a possible damage to the relieves or other parts of the dispenser, should the user strongly force the movement of the cover to other directions and following different procedures than described.

Other types of washing agents dispensers, such as multi-charge dispensers fitted with linear or angular movable covers, are provided with the compartment for containing the washing agent or washing agents sealed by closing the cover on the main body. To this purpose, an interference between the contacting seal elements will cause a mutual rubbing during the opening and closing operations of the cover. The above seal elements are arranged on the dispenser main body and on the movable cover to have them mutually compressed one upon the other when in contact. These sealing elements mainly comprise a sealing gasket, which may be integral to the body or cover, and an element on which the above gasket is maintained pressed, such as compartment edges.

The seal elements of these dispensers may be subject with time to abrasions due to their mutual rubbing with subsequent loss of the gasket sealing capacity, such a phenomenon being higher in the instance of possible solid detergent rests on the seals.

SUMMARY OF THE INVENTION

Therefore, it is the aim of the present invention to solve the above drawbacks and provide an improved washing agents dispenser device.

In this frame, it is an object of the present invention to facilitate the immediate closure of the sliding cover for the user of the dishwashing machine incorporating the dispenser device according to the invention; in particular, only a simple linear movement has to be actuated, pulling the cover to along a substantially regular even path, i.e. without exerting any crosswise or thrust pressure.

A further object is to facilitate the closure of the sliding cover and ensure appropriate sealing of the compartment in time, i.e. avoiding possible damages to the seal elements due to abrasions of the sealing surfaces in contact.

Another object, as better highlighted hereafter, is to reduce the damage risk of the device elements involved in the opening and closing movement of the cover, following a likely forced use of the dishwashing machine by the user, whenever the latter is unable to close the sliding cover by hooking it.

These objects and other aims to become more apparent hereafter are provided according to the present invention by a dispenser device incorporating the features of the annexed claims, which form an integral part of the description herein.

Further objects, features and advantages of the present invention will become more apparent from the following detailed description of two preferred non exclusive embodiments of the present invention shown in the annexed drawings supplied by way of non limiting example, wherein:

DESCRIPTION OF THE DRAWINGS

FIGS. 3 and 4 show a further side view, partially in section, of the device of FIG. 1 in a further operating position, and a detail of FIG. 3;

With reference to FIGS. 5-13, reference 1' indicates in its whole the dispenser device provided by the present invention as a first embodiment, which has a body 2' capable of being housed in the inner door of a dishwashing machine not shown for simplicity's sake.

The front side of the body 2' has a compartment 4' for containing a certain amount of washing agents, which may either be in the form of powder or liquid rather than in a solid form, such as tablets.

As it can be noticed in FIGS. 6, 9-12, the compartment 4' has an opening for loading the washing agents, and a substantially upright wall 26 ending with an inclined plane up to a lower edge 4'B of the compartment 4', so as to facilitate downfall by gravity of the detergent. The wall 26 generally has moulded relieves and/or writings, not highlighted in the above figures, in order to give indications about the amount of loaded detergent. The compartment 4' has side edges 4'A and the above lower edge 4'B near the opening, sideways and below, respectively, which protrude out of the profile or sight surface of the body 2'.

The term edge means any relief body over a surface, or also a limit or border, rather than a round end or lip, provided it is suitable for cooperating with sealing means, such as a rubber gasket, warranting a sealing purpose.

The above compartment 4' is capable of being closed by means of a sliding cover 5', which is coupled to the body 2' in order to perform a plane crosswise translation over a plane substantially matching or parallel to the plane of the dispenser or a wall of the washing tub, as better detailed hereafter.

Figure 1:
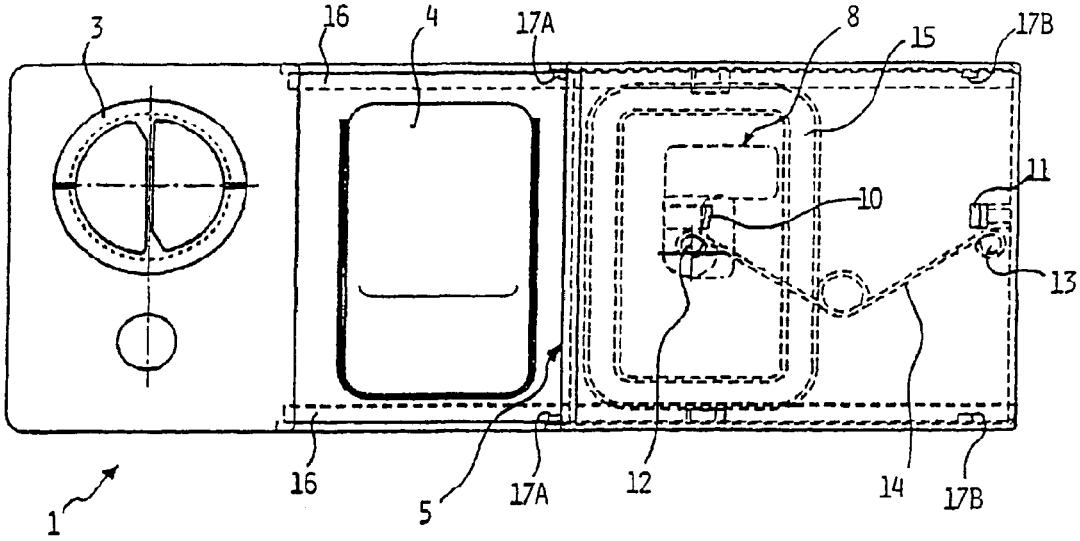
Fig. 1 PRIOR ART
FIGS. 1 and 2 show a front view and a side view of a known dispenser device in an operating position, respectively.
Figure 2:
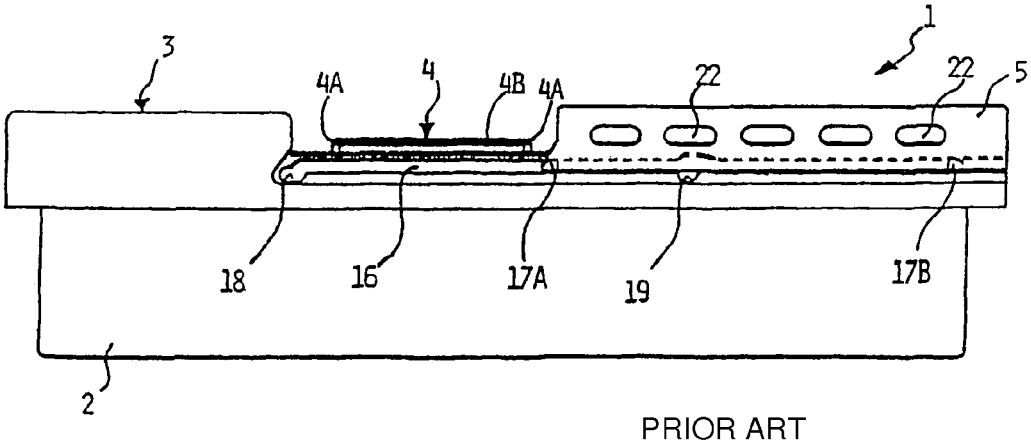
PRIOR ART Fig. 2
Figure 5:
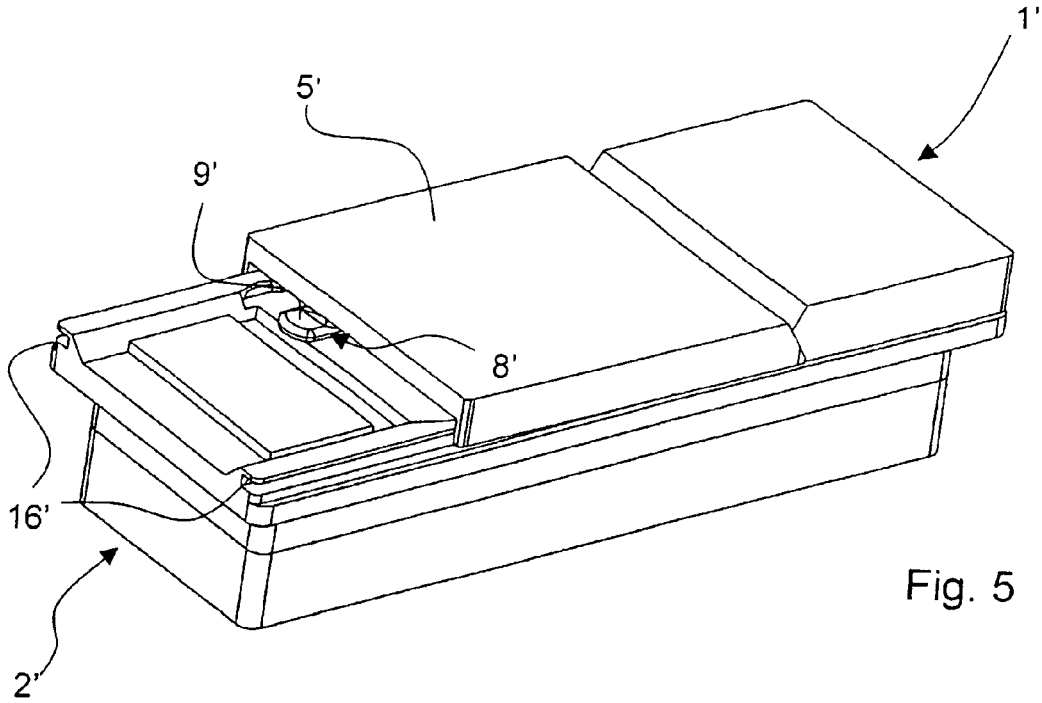
FIGS. 5 and 6 show two perspective views of a first embodiment of a dispenser device according to the present invention, in two different operating positions.
Figure 6:
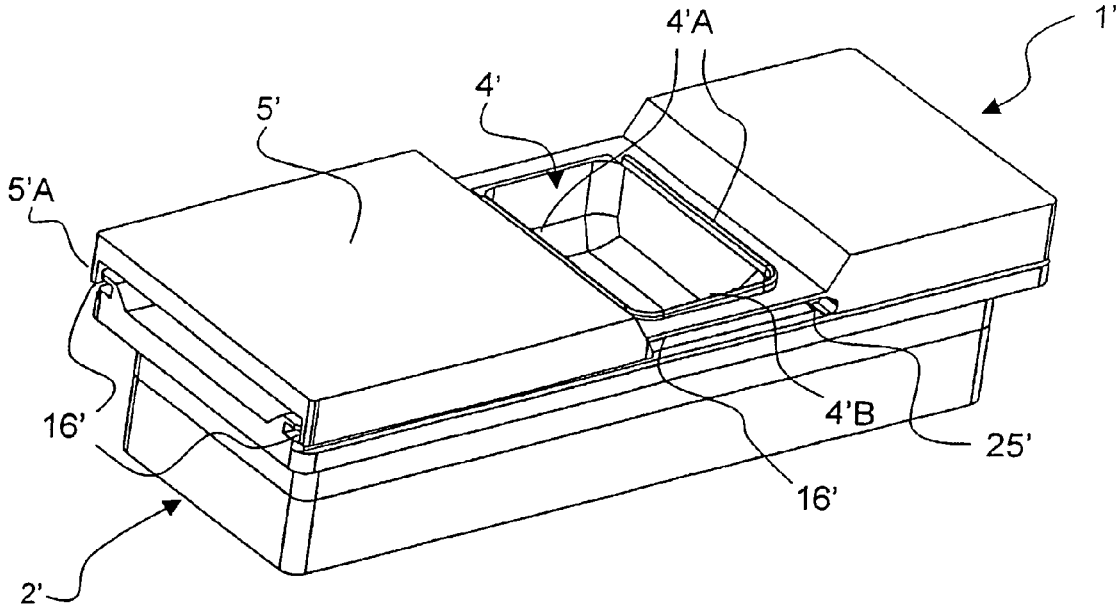
Figure 7:
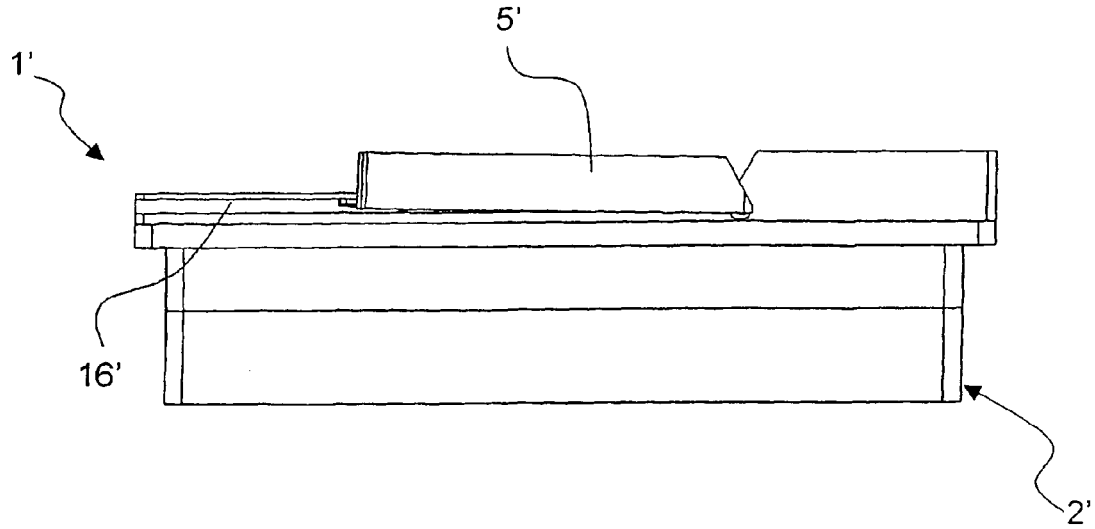
FIGS. 7 and 8 show two side views of the device of FIG. 5 in the same operating positions of FIG. 5 and FIG. 6, respectively.
Figure 8:
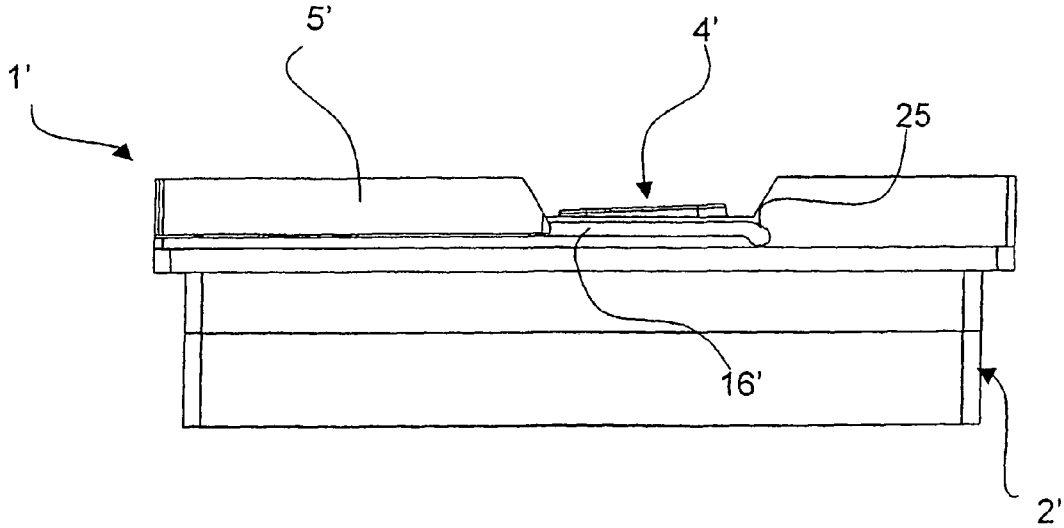
Figure 10:
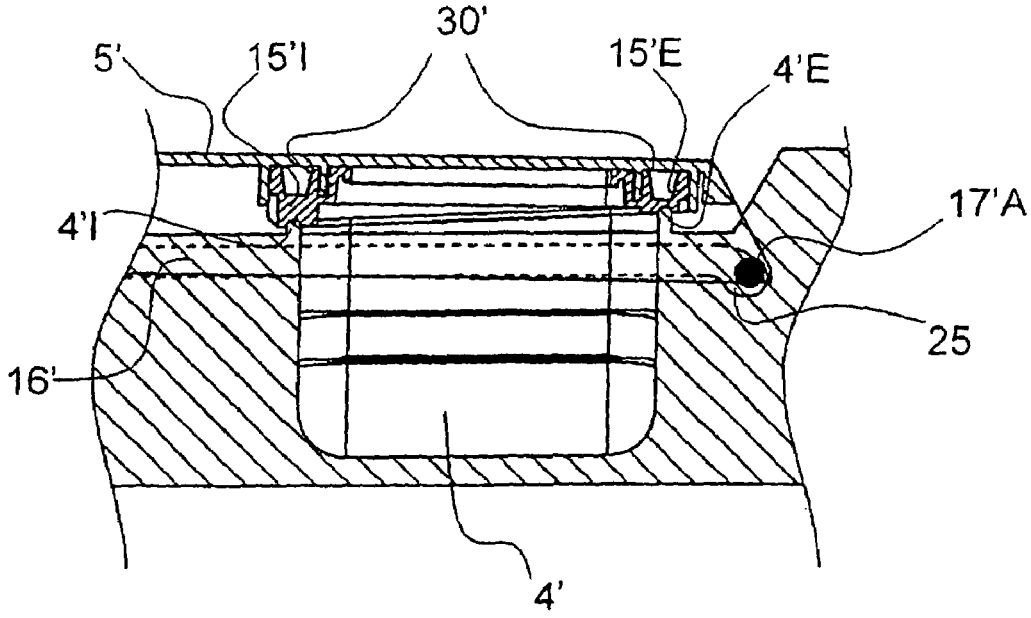
Figure 11:
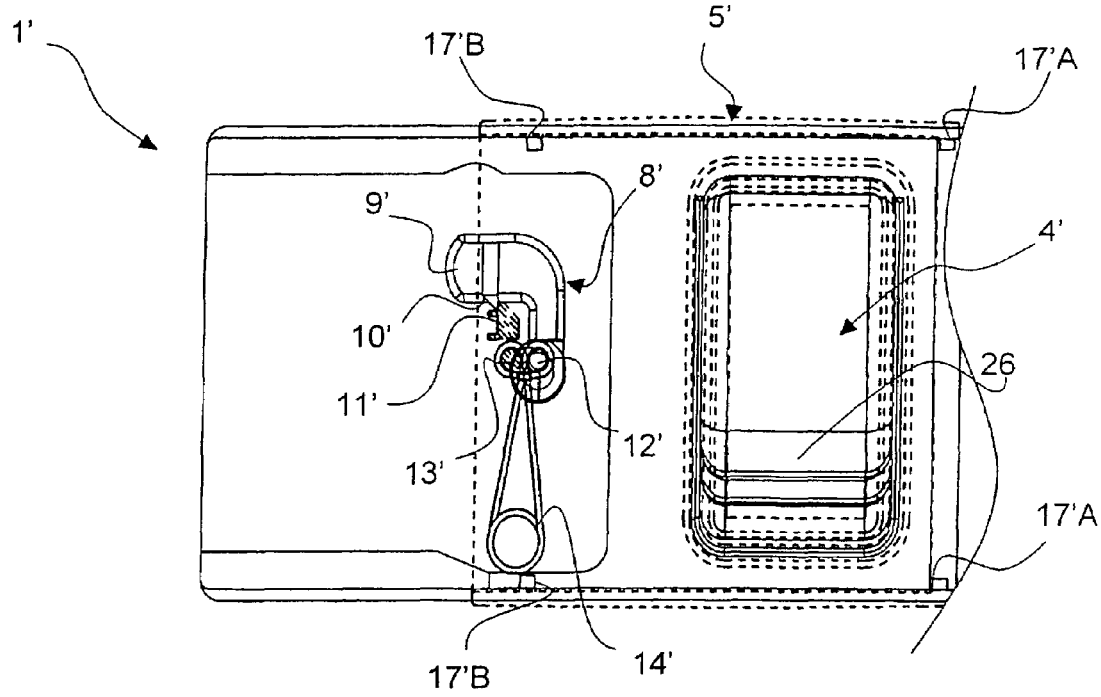
FIGS. 11 and 12 illustrate a partially truncated front view of the device of FIG. 5 in the operating positions as of FIG. 5 and FIG. 6, respectively.
Figure 12:
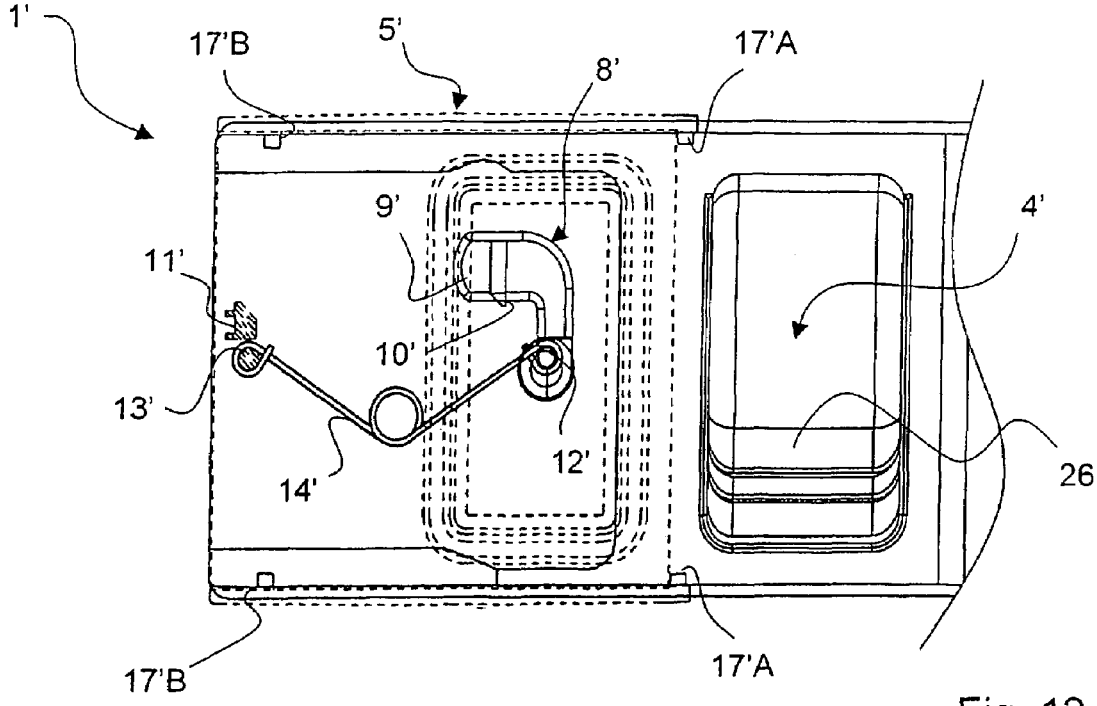

In particular, FIGS. 5, 7, 10 and 11 illustrate the dispenser device according to the present invention with the cover 5' closed, whereas FIGS. 6, 8 and 12 shown it with the cover 5' open.

In the rear side of the body 2' are housing a portion of the release/locking means according to the common art, not represented for simplicity's sake, which comprise an actuator being apt to move a lever angularly. This movement is performed either by direct contact with the exposed end of the actuator thrustor or through a leverage or kinematics as described hereafter, contrasting the action of an elastic or resilient element. Such a lever is integral to a shaft connected to a hooking element 8' present in the front part of the body 2', as clearly shown in FIGS. 5, 11 and 12. Motion of the above lever causes a rotation of the hooking element 8', which is rigidly connected to it through a shaft not visible in the above figures.

The above actuator may be an electromechanical or conveniently a thermal actuator, such as described in the application of the European Patent No. EP 940 577 in the Applicant's name.

One actuator alone may be appropriately employed both for the release and opening of the cover 5' and control the opening of a dispenser device of rinse additive or liquid washing agents, eventually available in the dispenser device 1'. This possibility is subsequently discussed in the final part of the description herein.

Figure 13:
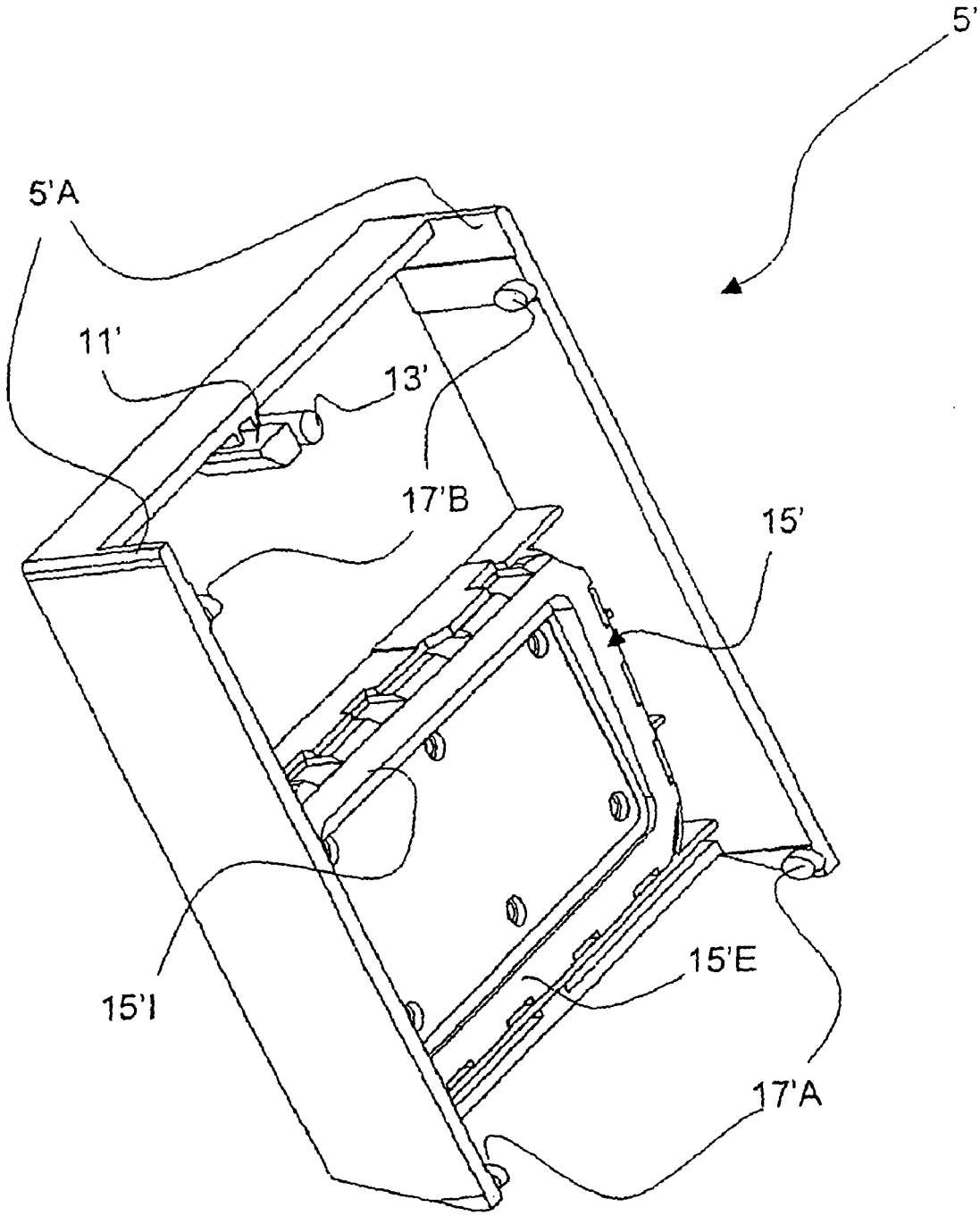
FIG. 13 shows a perspective view from inside of a detail of the device of FIG. 5.

The FIGS. 11 and 12 are illustrating the hooking element 8' more in detail, comprising a portion 9' being apt to be manually engaged for thrusting and/or rotation by the user of the dishwashing machine incorporating the dispenser device 1' according to the invention, and a hooking tooth or relief 10' having a substantially upright development, placed below the portion 9' of the hooking element 8'. In particular, this tooth 10' or relief is apt to move angularly over a plane parallel to the sliding plane of the cover 5', and engage a matching hooking tooth or relief 11', the latter also having a substantially upright development. This engagement is performed in such a way for the contact between both teeth 10' and 11' to occur along a substantially upright flat surface when the cover 5' is in a closed position. Said matching tooth or relief 11' is obtained on the inner surface of the cover 5' integral to it so as to protrude from the surface itself, as illustrated in FIG. 13. Preferably, this tooth 11' is made from thermoplastic material like the whole cover 5', and is obtained from one same moulding cycle.

DESCRIPTION OF THE PREFERRED EMBODIMENT

Moreover, FIGS. 11 and 12 show a first pin or hooking element 12' obtained on the hooking element 8' and integral to the body 2', whereas reference 13' indicates a second pin or hooking element obtained on the inner surface of the cover 5', the latter detail being clearly illustrated in FIG. 13. An elastic or resilient element 14' is housed in line with both pins 12' and 13', such as a cylindrical helical spring with its ends being apt to be fastened to the above pins or hooking elements 12' and 13', capable of operating as a thrust between the latter. The above ends have a ring form and are such to have the spring 14' loaded when the cover 5' is in closed position, as clearly illustrated in FIG. 11.

As it can be noticed in particular in the FIGS. 6, 9, 10 and 13, an elastic gasket is also fastened on the inner surface of the cover 5' being apt to ensure the required sealing on the side edge 4'A and lower edge 4'B delimiting the compartment 4' outside, which edges can also be clearly seen in FIG. 6.

Three items are now described more in detail as follows:

1) side edges 4'A of the compartment 4', which differ as first edge 4'E and second edge 4'I (reference is made in particular to FIGS. 9 and 10), since the first edge 4'E is protruding from the compartment 4' at a higher level than the second edge 4'E, meaning by first and second edges the nearer and farther edges from the limit stop of the cover 5', indicated as a flaring 25 and better specified hereafter;
2) compartment 4', without an upper edge as it can be noticed in FIG. 6, in order to let wash water inlet when the cover 5' closed, through a port delimited between the cover 5' and the outer surface of the body 2', in line with the above upper edge;
3) gasket 15', whose special form differs from the standard gaskets utilized in these devices, such as illustrated according to common art.

The gasket 15' is actually obtained by means of common procedures, with its sealing surface substantially pertaining to an inclined plane with respect to a plane parallel to the plane identified by the shell or outer surface of the cover 5', or to the motion plane identifying its opening/closing motion, as specified hereafter. The resting surface of the gasket 15', which is housed in a seat 30 obtained inside the cover 5', pertains on the contrary to a plane substantially parallel or matching the above outer surface of the cover 5' itself, as illustrated in the FIGS. 9 and 10. The gasket 15' has a first portion 15'E of its development, which protrudes more from the inner side of the cover 5' than a second portion 15'I, whose a difference in height is substantially equal to the one between the first edge 4'E and second edge 4'I of the compartment 4'; therefore, the sections have a variable geometry along its side portions. Fitting or assembly of the elastic gasket 15' on the inner side of the cover 5' is clearly illustrated in the perspective view from inside the cover 5' of FIG. 13.

As it can be noticed from FIGS. 5-10, a guide 16' is delimited lengthwise on each side or flank of the body 2', which is substantially an inner grove of the body 2' with a C section extending along a portion of the whole length; moreover, it has side extensions 5'A surrounding the flanks of the body 2' alike cover 5'.

Front relieves 17'A and rear relieves 17'B on the side extensions 5'A of the cover 5' are engaged inside the guides 16' and protrude inside the cover as illustrated in FIG. 13.

Development of these guides 16' and both the form and position of the relieves 17'A and 17'B are provided to ensure sliding of the relieves 17'A and 17'B inside the guides 16', and obtain a substantially plane motion of the cover 5' for the opening and closing of the compartment 4' for nearly its total extension.

FIGS. 5-10 also illustrate a substantially straightaway trend of the guides 16'; in the non limiting example therein they appear open on one side to provide a direct engagement of the relieves 17'A and 17'B and, consequently, easy assembly of the cover 5'. This solution ensures draining of the washing agents eventually depositing in the guides 16' during the wash cycles of the dishwashing machine incorporating the device 1'. In the opposite direction, i.e. towards the compartment 4', the substantially straightaway trend of the guides 16' stops whenever the upper profile inclines downwards just after overcoming the first edge 4'E, and ends with a flaring 25. This flaring 25, acting as a limit stop for the cover 5', is featured by an upper profile 25A formed following a plane inclined downwards, being shaped for housing and locking the matching front relief 17'A at a lower level than the one identified by the guide 16'.

Figure 9:
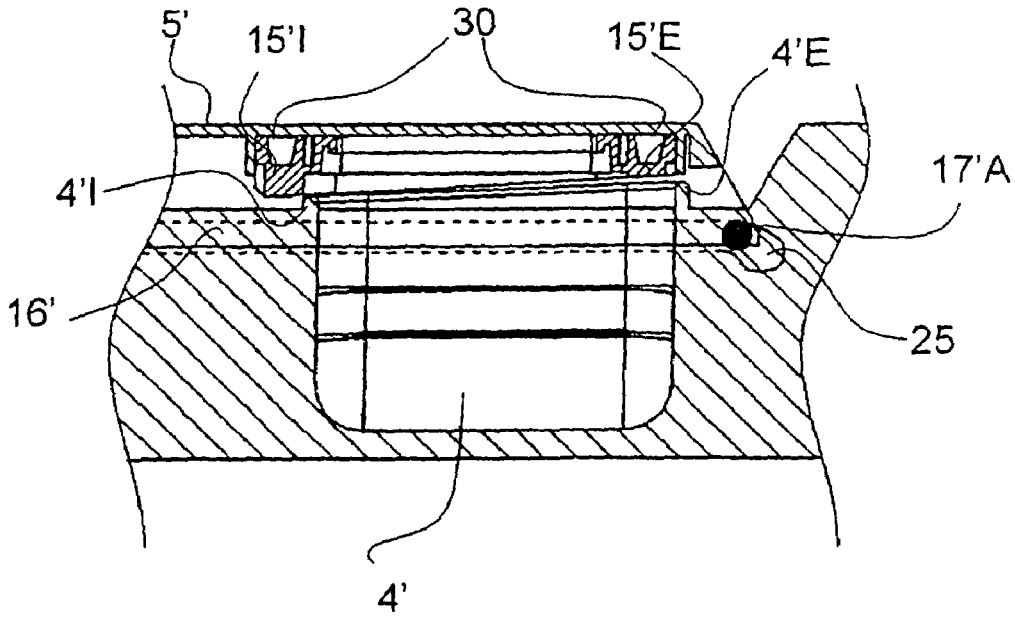
FIGS. 9 and 10 illustrate a lengthwise section view of a detail of the dispenser of FIG. 5 in two different operating positions.

In particular, FIGS. 9 and 10 illustrate the details of the cover 5' in two different configurations, directly before the limit stop and at the limit stop, respectively; at the limit stop, the first edge 4'E and second edge 4'I are engaged to the first portion 15'E and second portion 15'I of the elastic gasket 15', respectively. Thus, the latter is pressed for perfect sealing of the compartment 4' to likely washing agents infiltrations. The gasket 15' is housed inside the seat 30 obtained on the inner side of the cover 5'.

The front relieves 17'A and rear relieves 17'B related to the cover 5' and the guides 16' sideways the body 2' pertain to the means for constraining said cover 5' to the body 2'.

Operation of the device according to the invention is as follows.

The condition of closed cover 5' is assumed (FIGS. 5, 7, 10 and 11), with washing agents contained in the compartment 4'. The detail of the compartment 4' can be seen in the section view of the dispenser device 1 of FIGS. 9 and 10, as well as in FIG. 12.

Obviously, the elements of the dishwashing machine are not shown for simplicity's sake, because they are common elements already known.

The dishwashing machine is then started and washing starts according to the usual procedure. During the pre-wash a portion of the liquid sprayed by the sprayers of the dishwashing machine flushes the inner door and while flowing over it, a portion of it enters the compartment 4' through the port or opening between the cover 5' and the outer surface of the body 2' without upper edge, starting to thaw the washing agents.

At the appropriate time of the operating cycle, a programmer device pertaining to a control system of the dishwashing machine will control dispensing of the washing agents.

To this purpose, the programmer device supplies the actuator causing a movement of the above lever and consequently of the hooking element 8'. The angular movement of the hooking element 8' releases its hooking tooth 10' from its matching tooth 11' of the cover 5'. After release, the spring 14' is free to extend generating a thrust on the cover 5', thus causing a translation according to a substantially plane motion generated by the engagement of the front relieves 17'A and rear relieves 17'B inside the guides 16'.

It should be noticed how as soon as the actuator stops being supplied, the above elastic element will let the hooking element 8' rotate in the opposite direction, thus returning a thrustor or actuation element of the above actuator to its non-supply original position.

Therefore, when said cover 5' is in its closed position, releasing means 8', 9' for said cover can be identified, being apt to release mutually engaging means or teeth 10', 11' from their mutual contact; these releasing means 8', 9' of the cover (5') and these mutually engaging means 10', 11' moving during the hooking and release of said cover (5') with a substantially plane motion and in parallel to the motion plane of said cover (5').

The opening movement of the cover 5' is facilitated by the elastic reaction of the gasket 15' (see FIG. 13) going from a compression state to a release state, which contributes to displace the cover 5' in the sense of releasing the front relieves 17'A from their locking in the flaring 25. Thus, the relieves 17'A slide on the inclined plane above the flaring 25, and being thrust by the spring 14' they run along the guides 16' to the opening direction of the cover 5'.

Compared to the above common art, it is obvious how the flaring 25 is irrelevant for compressing the gasket 15' on the edges 4'E, 4'I and 4'B, since compression is ensured by the special inclination of the sealing surface with respect to the motion plane of the cover 5', as clearly highlighted hereafter.

It should also be mentioned how the elastic energy alone of the spring 14' is quite enough for ensuring an upward return of the front relieves 17'A.

Thus, the cover 5' goes from its closed position (FIGS. 5, 7, 10 and 11) to the open one (FIGS. 6, 8 and 12), with the compartment 4' facing directly inside the wash tub of the dishwashing machine; the washing agents, mixed to a certain amount of water entered through the upper port, are then able to fall inside the tub itself by gravity.

In the position shown in the FIGS. 6, 8 and 12, i.e. during the crockery washing and rinsing steps, when the detergent has by now been picked up, a portion of the water sprayed by the sprayers of the dishwashing machine can enter from the top for washing the hooking element 8', spring 14', teeth 10' and 11', and then be drained downwards to avoid scale formation due to washing agents rests.

Then the wash cycle goes on to the end.

It should also be mentioned that the cover 5' can be opened manually; to this purpose, the user will simply exert a light thrust on the portion 9' of the hooking element 8' for releasing the teeth 10' and 11' from their mutual engagement and obtain the automatic opening as previously described. FIGS. 5 and 11 highlight the access feature of the portion 9' from outside, since it protrudes from underneath the cover 5' when the latter is in its closed position.

As it can be noticed, in both conditions of closed cover 5' before dispensing the washing agents and open cover 5' after dispensing the washing agents, the means cooperating for the locking/release are always covered by the cover 5', i.e. they are protected against a deposit of washing agents particles and soil as well as against accidental impacts.

When the washing agents have to be loaded, the cover 5' is open and the washing machine door is in a substantially horizontal position; the user will only load the washing agents in the compartment 4' and close the cover 5' again.

Compared to the above known state of art, this operation is performed in a very simple straight manner in respect, since a translating movement is manually imparted to the cover 5' according to a straight path, without having to pull the cover 5' to a direction and then press at the appropriate time for a different direction, as occurring for the known state of art.

Actually, the user will pull the cover 5' manually to and let it slide from the position shown in the FIGS. 6, 8 and 12 to the position highlighted in the FIGS. 5, 7, 10 and 11 up to its performed hooking or engagement, with the contrasting strength of the spring 14' alone opposing a resistance to the movement. This movement ends when the matching tooth 11' of the cover 5' will snap on and be hooked according to common procedures to the matching hooking tooth 10' integral to the hooking element 8'.

Configuration of the guides 16' is particularly relevant for defining the movement of the cover 5', which have substantially a straightaway trend according to axes parallel to each other. By virtue of this configuration and since the movement itself is determined by the sliding of the relieves 17'A and 17'B inside the guides 16', the cover 5' has a substantially plane motion.

Compared to the known state of art, the guides 16' have a straightaway trend all over their path, save for their very last length; therefore, the relieves 17'A and 17'B sliding inside it will find no hindrance nor difficulty. The only resistance, obviously over the elastic reaction of the spring 14', for the user trying to close and lock the cover 5' is generated by the contact of the elastic gasket 15' with the side edge 4'A and lower edge 4'B; this contact delimiting an inclined sealing surface with respect to the plane identifying the motion plane of the sliding cover 5' between the opening and closing positions. A further resistance also occurs when the front relieves 17'A engaging the flaring 25 of the guides 16' meet the upper profile 25A, which bends downwards increasing the interference or telescoping between the first portion 15'E and second portion 15'I of the elastic gasket 15' with the relevant first edge 4'E and second edge 4'I of the compartment 4'. Another short translation will then cause the defined penetration; in particular, the second portion 15'I slides on the second edge 4'E telescoping with it over its very last length, whereas the first portion 15'E will lower directly on the first edge 4'E, and press it.

Practically, the motion of the cover 5' sliding between the closing and opening positions, and vice-versa, is a substantially plane motion all over its path, with its direction slightly inclined for a very short length only, which is quite irrelevant for sealing purposes. This is the length in line with the hooking position of the teeth 10' and 11' or when the front relieves 17'A are engaged in the flaring 25 of the sliding guides 16' in the body 2'.

When the user closes the cover 5', the above operation is perfectly sliding and straight also for a careless inattentive user; the user is actually able to close and hook the cover 5' at its first strike by simply pulling it to, without complications. Moreover, no pressure nor crosswise movement is required for engaging the tooth 10' to hook the tooth 11', compared to the common state of art.

Advantageously, it will also hinder a particularly unmindful user from forcing the closing movement, preventing possible damages to the relieves 17'A and 17'B inside the guides 16'.

As a further advantage, it will also prevent a faulty closure of the cover 5', which may cause a bad wash-cycle performance of the dishwashing machine.

Another advantage compared to the execution previously mentioned is surely due to a minor complexity of the dispenser device 1 according to the invention, whose simplified configuration of the guides 16' entails full advantage for production logistics and less global costs.

Finally, it is obvious that many other changes are possible for the man skilled in the art to the actuation device as described above by way of example, without departing from the novelty principles of the inventive idea, and how in practical actuation the forms and dimensions of the components may differ from the ones used for its manufacture.

For instance, the cover inner seat may have an appropriate form for using a gasket absolutely similar to the one in use for the common art; this means that the first and second portions of such a gasket are located at the same level, i.e. its outer and inner surfaces belong to mutually parallel planes. To this purpose the gasket seat should be simply designed to have a relevant support with an appropriately inclined trend with respect to the cover motion plane or translation plane. The inner seat is so designed to have the gasket supporting plane substantially inclined with respect to the cover motion plane, but parallel to the plane related to the sealing surface to be delimited by the interaction of the compartment edges. It is obvious, too, that such a gasket may be assembled in an appropriate seat near the compartment edge, the cover edges according to this implementation being apt to cooperate with the gasket described above.

In this instance, the use of a widely spread gasket type is undoubtedly advantageous, i.e. more reliable and less expensive than a gasket having inclined surfaces.

The peripheral sections of the above gasket may have substantially consistent dimensions or variable dimensions.

Additionally, besides the above compartment 4' for containing the washing agents, it is appropriate and useful to provide the body 2' of the dispenser device 1 according to the invention with a liquid rinsing additive dispenser. As illustrated in the example of FIGS. 1-4, this may be housed sideways the compartment itself opposite to the side engaged by the cover 5' during the opening step.

Now we go back to the previous question about the locking/release mechanism for the sliding cover of a dispenser according to the invention located inside the washing tub of a dishwashing machine, according to which one actuator alone can control both the opening of the cover 5' and dispensing of a liquid rinsing additive or liquid washing agents.

Control of both operations may be appropriately obtained through the above movable leverage or kinematics associated to the dispenser body and controlled by a thrustor stroke, or movable end of the thermal actuator. As a basic element technically known, this leverage includes for instance a flat cam also called "heart-shaped" cam, which ensures sequential actuation of said lever during a first stroke of the thrustor and the opening of a shutter for dispensing the rinsing additive in the washing tub during a second stroke of the thrustor.

It is also known how the compartment for containing a liquid rinsing additive or liquid washing agents generally bears inside a so-called "spoon" device, which is adequately formed for its inside automatic loading with a rinse-aid dose when the door of the dishwashing machine, incorporating the dispenser device in its inner door, is open and takes a substantially horizontal position. Moreover, the above spoon device has a duct in its lower section communicating outside the body through an opening, whose through-section is clogged by the above shutter. This shutter can be commonly opened by the above leverage, and has an elastic return element for closing the duct again after the actuation step or rinse-aid dispensing.

The rinse-aid compartment is generally closed on its top by a plug, which can be easily removed for its filling from outside. It may be fitted inside with an arrangement having a graduated knob to be set on several positions, being apt to regulate the amount of rinsing additive to be dispensed.

The means previously mentioned reporting no references in the annexed drawings are known to the present state of art.

Figure 15:
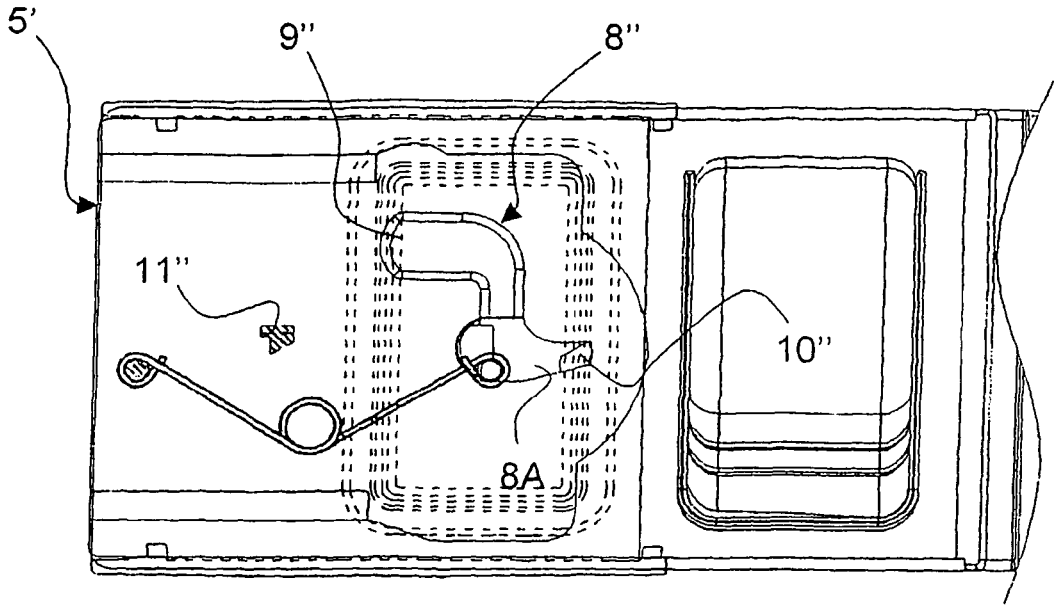
FIGS. 14 and 15 illustrate a possible implementation of the device of FIG. 5 in the same views of FIGS. 11 and 12, respectively.
Figure 14:
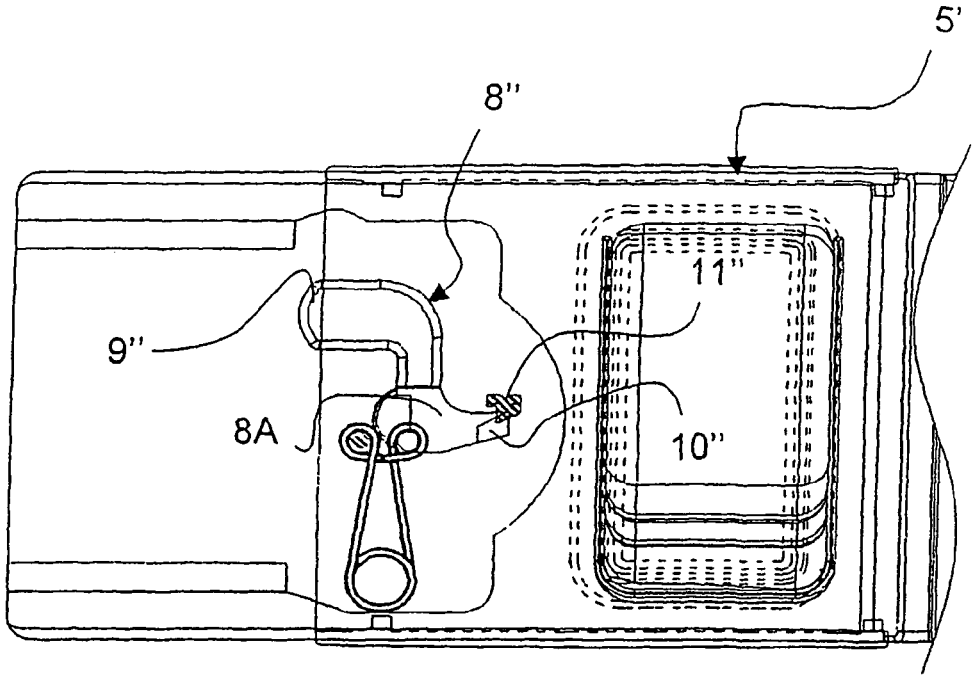

Moreover, all the details illustrated and described can be replaced with other technical equivalent elements, such as a locking/release device of the cover 5' as described hereafter and illustrated in the FIGS. 14 and 15, which is equivalent to the device shown in FIGS. 11 and 12. These figures illustrate a swivelling rocker arm 8" on the body 2' of the dispenser 1', which comprises a first end portion 9" being apt to be manually engaged by means of a thrust and/or rotation by a user of the dishwashing machine, and a second end portion 8A having a hooking tooth 10". This hooking tooth 10" is obtained on the opposite side of the fulcrum of the rocker arm 8" and is apt to engage a matching hooking tooth 11"; this hooking occurring through a preliminary contact between two inclined planes of the relevant teeth 10" and 11", said planes being conjugated with respect to the crosswise closing motion of the cover 5' in such a way that by mutually sliding one on top of the other, a mutual contact is reached at the closing position according to a flat surface having substantially an upright development.

The matching tooth 11" is obtained integrally on the inner surface of the sliding cover 5', protruding from the surface itself.

Advantageously, this implementation ensures hooking, and above all an easier release compared to the first solution between the teeth 10" and 11", since a minor stroke or rotation of the portion 9" to be released, as well as a minor rotation of the hooking element 8" to be hooked is required. Thus, the cover may be closed and opened in a more efficient and comfortable manner by a user of the dishwashing machine incorporating the above dispenser device.

Also according to this implementation it is obvious how in order to hook the cover 5' in its closed position no pressure nor crosswise movement are required, but only the movement previously mentioned pulling the cover 5' to, for closing the compartment 4'.

A second embodiment of the dispenser device according to the invention is illustrated in the FIGS. 16-19, where a washing agents dispenser is indicated with 51 schematically as a whole, comprising a body 52 with inside a compartment 53 for containing the washing agents. This compartment 53 has a semicircle opening with a cover 54 also with a semicircle form movably associated to it, which is capable of rotating around an axis orthogonal to the opening of the compartment 53, between an open position and a closed position.

In its assembled position in a proper room 60 inside the body 52, the cover 54 advantageously formed as a one-piece element is movably engaged through its shaft or cylindrical pin 54A solidly connected to the cover 54. This coupling 52 and 60 ensures rotation between the open position of FIG. 16 and closed position of FIG. 17 through common means not represented for simplicity's sake. This cover 54 also has an outer or relieved grip 54B, being apt for actuation or thrust by a user of the dishwashing machine incorporating the device 51 for the angular movement of the cover 54.

Figure 18:
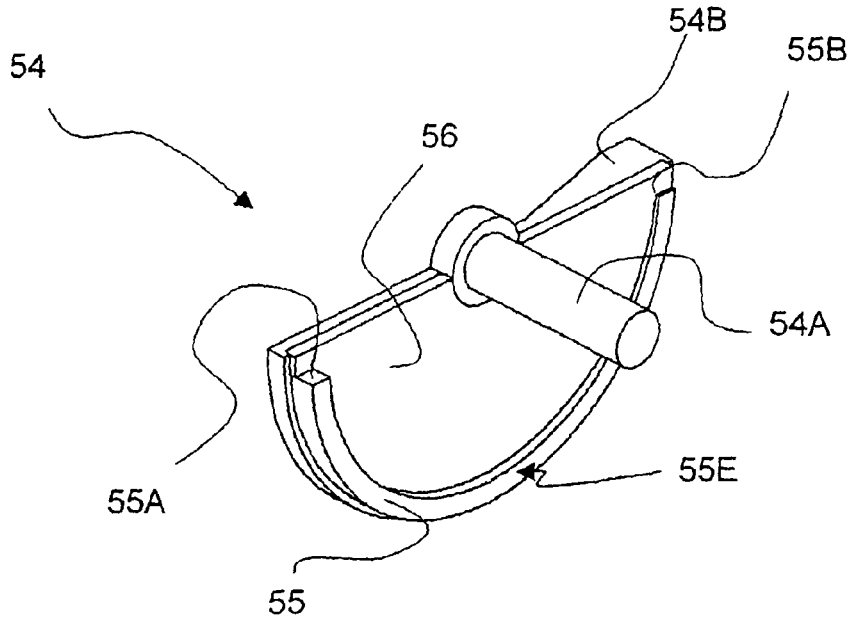
FIGS. 18 and 19 show a perspective view and assembled view according to a truncated lengthwise section of a detail of the device of FIG. 16, respectively.

FIG. 18 is illustrating a perspective view of the assembled cover 54, where a gasket 55 is housed in a seat formed inside the cover 54 itself and locked by means of a fastening element 56, in particular in the form of a half-disk, hindering its movement. This gasket 55 is formed to have at least a portion of its outer semicircle surface pertaining to a skew or inclined plane with respect to the motion plane of the cover 54 or its outer surface. Therefore, it has a first distal end 55B protruding inside the cover 54 at a lower level compared to a second distal end 55A.

The gasket 55 is substantially solidly assembled to the cover 54 in line with its outer circular perimeter, having its distal ends 55A and 55B located at different levels near the diameter of the semicircle sector forming the cover 54.

Figure 19:
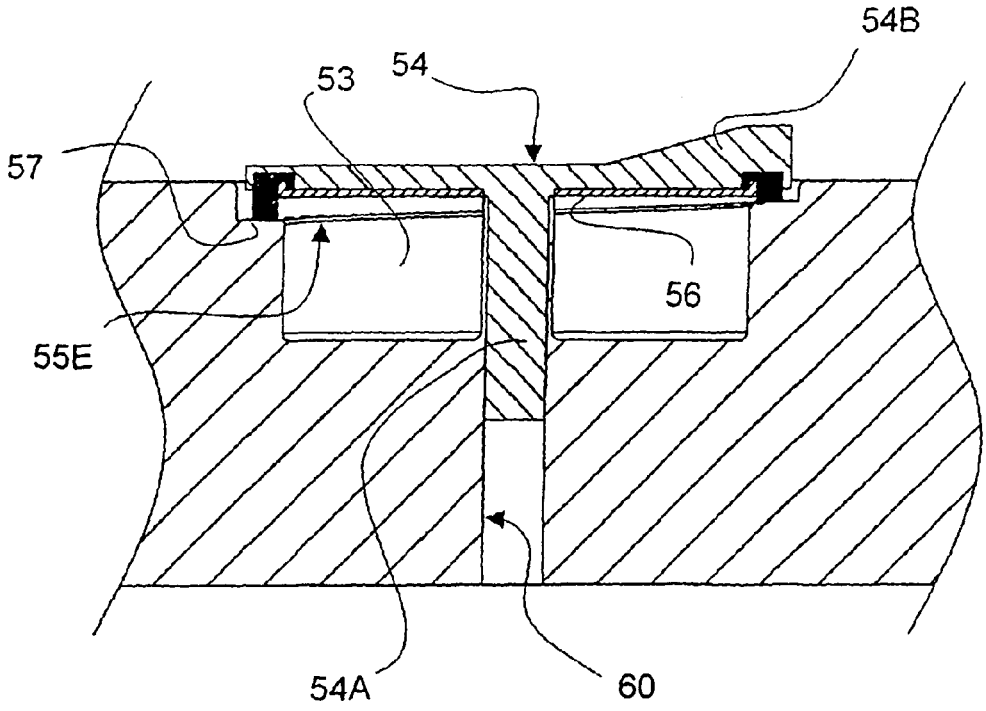

FIG. 19 illustrates an edge 57 of the compartment 53 built in inside the body 52; said edge 57 having a form conjugated to the form of the gasket 55 and capable of coupling with it, in particular as a semicircle sector; moreover, has its sight surface pertains to a skew plane substantially parallel to a contact surface 55E delimited on the gasket 55.

By virtue of this configuration, during the closing motion of the cover 54, which moves angularly following a substantially plane motion, the contact surface 55E of the gasket 55 engages under compression the built-in edge 57. In the last short length of the movement path of the cover 54, a large portion of the contact surface 55E slides on the relevant length of the sight surface of the seat 57, with the gasket 55 being subsequently pressed on the length where the cover 54 will perform its last short rotation and hook up; this compressive operation between the gasket 55 and built-in edge 57 ensures sealing of the compartment 53.

The dispenser device 51 is fitted with a locking/release device, as well as with a control for opening the cover 54 and likely compartments containing common rinsing additives or liquid washing agents; all elements of known devices are not represented in the above figures.

Advantageously, this implementation shows a further technical solution for closing the cover 54 to the user of a dishwashing machine incorporating the dispenser device according to the invention, warranting an appropriate duration of the friction materials, i.e. avoiding possible damages to the sealing elements due to abrasions of the contact sealing surfaces.

Figure 16:
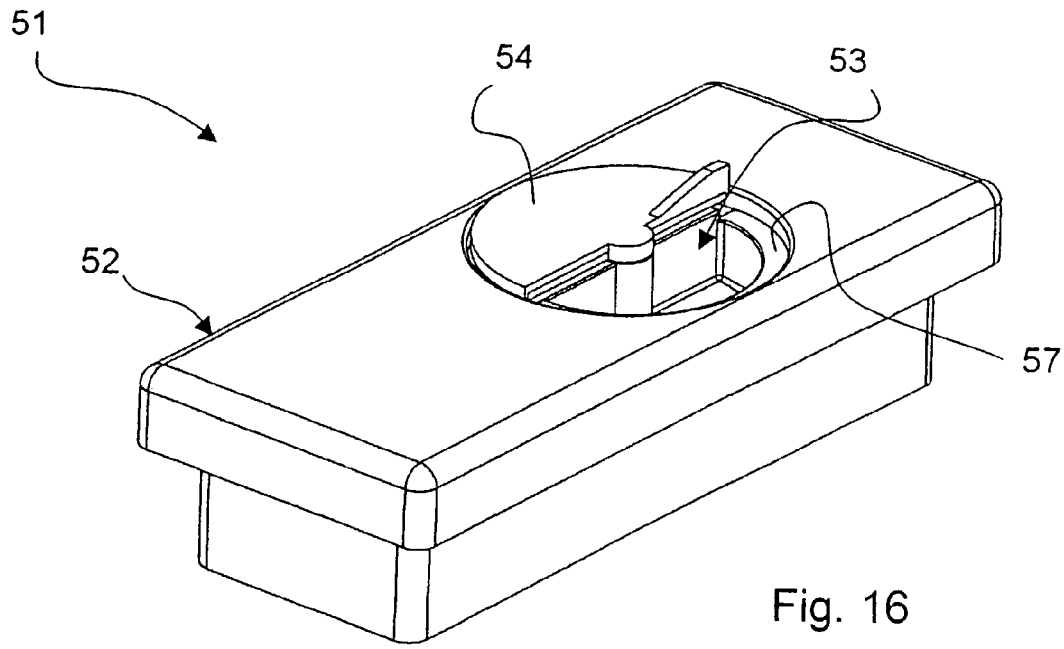
FIGS. 16 and 17 show a perspective view of a second possible representation of the device according to the invention, in two different operating conditions.
Figure 17:
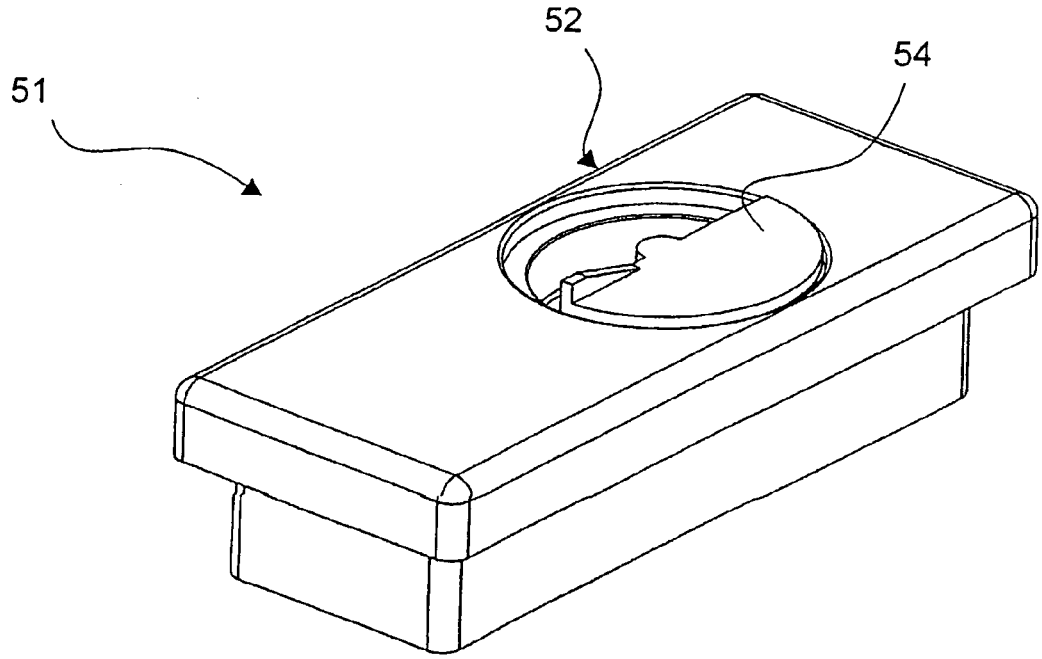
Figure 21:
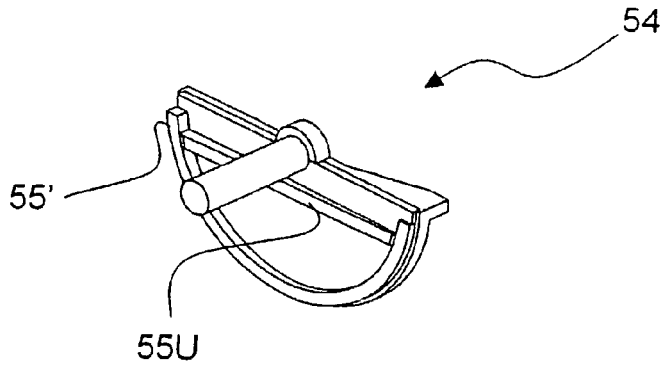
FIGS. 20 and 21 show a perspective view of an implementation of the device of FIG. 18 and a relevant detail, respectively.
Figure 20:
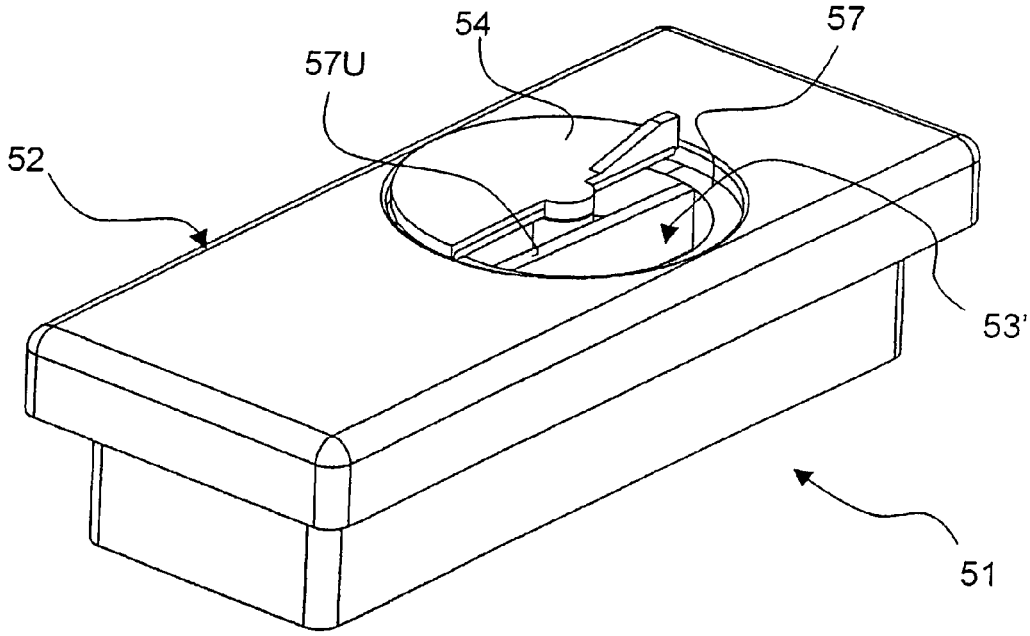

FIGS. 20 and 21 are representing a possible implementation of the dispenser of FIG. 16 with a schematic representation according to the procedures previously described. According to this implementation, the dispenser 51 represented in its whole, is entirely analogous to the previous one, save for the particular configuration of the built-in edge inside the body 52 of the dispenser device 51, and for a relevant conjugated gasket 55' of the cover 54 associated to a compartment 53', which is slightly modified inside compared to the previous configuration.

This edge 57 has a modified form compared to the form 57 of the implementation of FIGS. 16-19; it comprises a further length 57U in the body 52, having a straightaway trend, whose sight surface connects diametrically the portion formed as a semicircle sector; the surface of the further length 57U pertaining to the same skew plane of the remaining surface. The form of the gasket 55' conjugated to the edges 57 and 57U, has a further length 55U with a straightaway trend, which joins diametrically its semicircle sector portion.

The outer surface of the further length 55U pertains to the same skew plane to which also belongs the remaining surface and it is apt to interact with the edges 57 and 57U for sealing the compartment 53' when the cover 54 is closed. Also this implementation shows the apparent advantage of a seal without any risk of abrasions, providing at the same time a simple linear interference-free closing movement of the cover 54 to the user of the dishwashing machine.

The invention claimed is:

1. A washing agents dispenser device for dishwashing machines, comprising:

a body, a compartment in said body for containing a washing agent, a cover associated to said compartment, being movable from a closed position to an open position of said compartment, restraining means adapted to restrain said cover to the body, so that said cover is capable of moving according to a plane motion from said open position to a position adjacent said closed position, a locking/release system of said cover with respect to the body, comprising actuating means, first sealing means associated to said compartment, second sealing means operatively connected to said cover, wherein said restraining means are further adapted to maintain, said first sealing means and said second sealing means out from their mutual contact during the most of the operation path of said cover, and wherein said cover in its closed position is adapted to ensure a mutual compression between said first and second sealing means, said mutual cooperation or compression identifying and delimiting a seal on part of the compartment, wherein, said second sealing means is partially inclined with respect to the plane identifying said plane motion of said cover and said restraining means are shaped such in a way to ensure said plane motion until said first sealing means and said second sealing means reach a position where they undergo mutual compression producing a seal on part of the compartment said first sealing means and/or said second sealing means comprising edges and/or gaskets and/or relieves and/or any arrangements of means adapted to obtain a suitable sealing in mutual cooperation, said gasket having an outer surface for getting a compression with said edges of said compartment when said cover is in its closed condition, and wherein said compression between said first and second sealing means in said closed position is caused by said restraining means, and wherein said restraining means comprises guides extending lengthwise on at least two sides of said compartment and further comprising cooperating relieves engaged inside said guides, so as to allow said first and said second sealing means to undergo mutual compression when said cover is in its closed position, and wherein said cover in its movement between said open position and said position adjacent to said closed position moves substantially parallel to itself, keeping said second sealing means inclined with respect to said planar movement, and wherein said first sealing means have a front part and a rear part, and said second sealing means have a front portion and a rear portion, said front part of said first sealing means being in touch with said front portion of said second sealing means when the cover is in said closed position, and said rear part of said first sealing means being in touch with said rear portion of said second sealing means when the cover is in said closed position, said front portion of said second sealing means protruding less from the inner side of the cover than said rear portion of said second sealing means, and said front part of said first sealing means protruding more from the compartment than said rear part of said first sealing means, and wherein during said cover motion between said open position and said closed position said front portion of the second sealing means overcome completely said rear part of said first sealing means without coming in contact with it.

2. A device, according to claim 1, wherein said sealing surface is partially inclined or substantially bent in the sense of incrementing its level following the direction of the cover in its movement from the open position to the closed position.

3. A device, according to claim 1, wherein said first sealing means are protruding near the border of said compartment, forming a portion of its perimeter.

4. A device, according to claim 1, wherein said first sealing means are integral with said body.

5. A device, according to claim 1, wherein said first sealing means comprise said edges and said second sealing means comprise said gasket.

6. A device, according to claim 5, wherein said edges of said compartment comprise a first portion protruding out of the profile of the body of said device at a higher level with respect to a second inner portion, with a lower edge joining them, being adapted together to delimit said sealing surface.

7. A device, according to claim 1, wherein said second sealing means are firmly operatively connected to said cover.

8. A device, according to claim 1, wherein said gasket comprises a first portion protruding inside the sliding cover at a lower level with respect to a second portion, with a difference in height substantially equal to the one between said outer edge and inner edge of said compartment.

9. A device, according to claim 1, wherein said gasket is assembled in its operating position for supporting a plane substantially parallel to said plane identifying said substantially plane motion, or the outer shell of said cover.

10. A device, according to claim 9, wherein said gasket has below a plane supporting surface for said cover and above an inclined surface with respect to said supporting surface, with its inclination angle substantially equal to the angle formed by said sealing surface being adapted to ensure a partial sealing on the compartment, said plane identifying said substantially plane motion of said cover, or its outer shell.

11. A device, according to claim 1, wherein said gasket has its outer contact surfaces pertaining substantially to planes that are parallel to each other, the supporting surface of the seat housing said gasket being plane and inclined with respect to the plane identifying said substantially plane motion of said cover, or its outer shell.

12. A device, according to claim 1, wherein the peripheral development of said gasket has sections with substantially consistent dimensions.

13. A device, according to claim 12, wherein said gasket is assembled in its operating condition in supporting to a plane substantially parallel to the plane identifying said sealing surface.

14. A device, according to claim 1, wherein the development of the gasket has sections of variable dimensions.

15. A device, according to claim 1, wherein said actuating means of said locking/release system comprise thrusting means being adapted to move said cover from the closed position to the open position.

16. A device, according to claim 15, wherein said thrusting means comprise an elastic element adapted to operate between a hooking element integral to said body and a further hooking element of said cover.

17. A device, according to claim 1, wherein said locking/release system comprises mutual engaging means between said cover and said body, adapted to lock said cover in its closed position when it is manually closed by the user of a dishwashing machines equipped with said device.

18. A device, according to claim 17, wherein said locking/release system comprises means for releasing said cover when it is in its closed position, being adapted to release said mutually engaging means from their mutual contact; said means for releasing said cover and said mutually engaging means moving according to a substantially plane motion parallel to the motion plane of said cover during the hooking and release of said cover.

19. A device, according to claim 18, wherein said means for releasing comprise a hooking element swivelling on the body of the dispenser, said hooking element comprising an end portion being adapted to be manually engaged by thrust and/or rotation by the user of the dishwashing machine, and a hooking tooth or relief below said end portion having substantially an upright development; said hooking tooth being capable of engaging a matching hooking tooth with a substantially upright development of said cover, said hooking occurring through a preliminary contact between two inclined planes of said mutually engaging means, said planes being conjugated with respect to the substantially plane closing motion of said cover.

20. A device, according to claim 18, wherein said means for releasing comprise a rocker arm swivelling on the body of the dispenser, said rocker arm comprising:

a first end portion, being adapted to be manually engaged by thrust and/or rotation by the user of the dishwashing machine, a second end portion, which comprises a hooking tooth obtained on the opposite side with respect to the fulcrum of said rocker arm, being adapted to engage a matching hooking tooth of said cover; said hooking occurring through a preliminary contact between two inclined planes of said mutually engaging means, said planes being conjugated with respect to the closing movement of said cover.

21. A device, according to claim 1, wherein said compartment has no upper edge, whereby the wash water can flow in, with the cover in a closed position, through a port between said cover and the outer surface of the body near said compartment.

22. A device, according to claim 1, wherein said first sealing means comprise said gasket and said second sealing means comprise an edge integral to said cover.

23. A device, according to claim 1, wherein said gasket has an outer surface pertaining substantially to an inclined plane with respect to the plane identifying said substantially plane motion.

24. A device, according to claim 1, wherein said first and/or second sealing means are adapted to facilitate the closing operations of the cover.

25. A device, according to claim 1, wherein said means for restraining said cover to said body comprise guiding means, being adapted to provide a regular even movement without jolting or discontinuity of said cover, until said first sealing means and said second sealing means come in contact with each other or cooperate for a sealing of said compartment.

26. A device, according to claim 25, wherein said guiding means comprise sliding guides integrated to or obtained on said body.

27. A device, according to claim 26, wherein said guides are mounted on the sides of said body.

28. A device, according to claim 26, wherein said guides have a mainly straightaway trend, or have no seats nor relieves over a main portion of their own path for ensuring said substantially plane motion of said cover.

29. A device, according to claim 26, wherein said guides end with some flarings having their relevant upper profile inclined downwards.

30. A device, according to claim 26, wherein said means for restraining said cover to the body comprise front relieves and rear relieves pertaining to said cover, being adapted to be engaged in said guides of said body.

31. A device, according to claim 30, wherein said front relieves and rear relieves are on side extensions featuring said cover and protruding inside it.

* * * * *